US006479738B1

(12) United States Patent
Gilmore

(10) Patent No.: US 6,479,738 B1
(45) Date of Patent: Nov. 12, 2002

(54) PIANO TUNER

(76) Inventor: Donald A. Gilmore, 930 Broadway, #101, Kansas City, MO (US) 64105

( * ) Notice: Subject to any disclaimer, the term of this patent is extended or adjusted under 35 U.S.C. 154(b) by 0 days.

(21) Appl. No.: 09/893,384

(22) Filed: Jun. 27, 2001

(51) Int. Cl.[7] ..... G10G 7/02
(52) U.S. Cl. ..... 84/454; 84/DIG. 18
(58) Field of Search ..... 84/725–728, 454–460, 84/DIG. 18

(56) References Cited

U.S. PATENT DOCUMENTS

| | | | | |
|---|---|---|---|---|
| 2,207,450 A | | 7/1940 | Bergen et al. | |
| 3,530,756 A | | 9/1970 | Chapman | |
| 3,588,311 A | | 6/1971 | Zoller | |
| 3,675,529 A | | 7/1972 | Van Der Woerd | |
| 4,041,783 A | | 8/1977 | Shimauchi et al. | |
| 4,044,239 A | | 8/1977 | Shimauchi et al. | |
| 4,075,921 A | | 2/1978 | Heet | |
| 4,077,298 A | | 3/1978 | Kondo | |
| 4,184,398 A | | 1/1980 | Siegelman | |
| 4,196,652 A | | 4/1980 | Raskin | |
| 4,271,746 A | | 6/1981 | Dobbie | |
| 4,319,515 A | | 3/1982 | Mackworth-Young | |
| 4,351,216 A | * | 9/1982 | Hamm | 84/DIG. 18 |
| 4,354,418 A | * | 10/1982 | Moravec et al. | 84/454 |
| 4,375,180 A | | 3/1983 | Scholz | |
| 4,484,506 A | | 11/1984 | Sato | |
| 4,941,388 A | | 7/1990 | Hoover et al. | |
| 5,010,575 A | | 4/1991 | Marutake et al. | |
| 5,018,428 A | * | 5/1991 | Uchiyama et al. | 84/654 X |
| 5,065,660 A | | 11/1991 | De Buda | |
| 5,285,711 A | | 2/1994 | Sanderson | |
| 5,349,130 A | * | 9/1994 | Iwaooji | 84/454 X |
| 5,523,526 A | | 6/1996 | Shattil | |
| 5,585,588 A | | 12/1996 | Tumura | |
| 5,719,343 A | | 2/1998 | Reyburn | |
| 5,736,661 A | | 4/1998 | Armstrong | |
| 5,756,913 A | | 5/1998 | Gilmore | |
| 5,780,759 A | | 7/1998 | Szalay | |
| 5,854,437 A | * | 12/1998 | Merrick et al. | 84/454 |
| 5,929,360 A | | 7/1999 | Szalay | |
| 5,932,827 A | | 8/1999 | Osborne et al. | |
| 5,936,179 A | | 8/1999 | Merrick et al. | |
| 5,949,014 A | | 9/1999 | Rashak et al. | |

OTHER PUBLICATIONS

Interconnect Devices, Inc. Interconnect Devices, Inc. Catalog, Nov. 2000, p. 38, 6th Edition, Kansas City, Kansas, United States of America.

* cited by examiner

*Primary Examiner*—Stanley J. Witkowski
(74) *Attorney, Agent, or Firm*—Blackwell Sanders Peper Martin LLP

(57) ABSTRACT

A device for tuning a piano that attaches to adjacent strings of the piano and positions magnetic pickups over the strings with the magnetic pickups detecting the vibration of the strings without interference with them.

26 Claims, 4 Drawing Sheets

PIANO TUNER

BACKGROUND OF THE INVENTION

1. Field of Invention

This invention relates to tuning devices, and more particularly to a device that attaches to the strings of a piano and has magnetic pickups over the strings for tuning the piano.

2. Background of the Invention

Musical instruments have been tuned in a variety of ways using both mechanical and electronic devices. One conventional method for tuning a piano requires an experienced tuner to manually turn the tuning pins with a special wrench. The tuner then determines when it is in tune by either using a tuning fork or an electronic strobe tuner as aids and systematically tuning each string using complex, learned methods.

Another prior art method of tuning musical instruments employs measurements made of the inharmonicities of three notes. One of the three notes is a standard note tuned to standard frequency.

Another prior art method determines tuning frequencies for an instrument by sounding at least three notes on the instrument which are recorded and digitally filtered to generate directly partial ladders representative of the notes.

However, the prior art does not disclose an apparatus or method for comparing a value for a tuning period against a baseline period value in order to evaluate a tuning signal.

SUMMARY OF THE INVENTION

This invention relates to a device for tuning a musical instrument that preferably attaches to adjacent strings of the instrument and positions magnetic pickups over the strings with the magnetic pickups detecting the vibration of the strings. Preferably, the device includes a detector operable to receive string vibrations and to produce a detected signal. In a preferred embodiment, the device also includes a processor operable to receive the detected signal and determine a first value for a tuning period of the detected signal, and to compare the first value for the tuning period of the detected signal to a second value for a baseline period of a musical note to evaluate the detected signal.

It is an object of the present invention to provide for an improved tuning device.

Another object is to provide for such a device wherein there are three strings of the piano with magnetic pickups over the strings, which pickups are used to detect vibrations of the strings without interfering with the strings.

These and other objects and advantages of the present invention will become apparent to readers from a consideration of the ensuing description and the accompanying drawings.

BRIEF DESCRIPTION OF THE DRAWINGS

FIG. 1(*b*) is a schematic side view of the FIG. 1(*a*) positioned with the same extending lines before being attached to the strings of a piano.

FIG. 1(*c*) is a schematic side view of the present invention showing the engagement of the underside of the housing with three different sets of piano strings.

DESCRIPTION OF A PREFERRED EMBODIMENT

Figure 1:
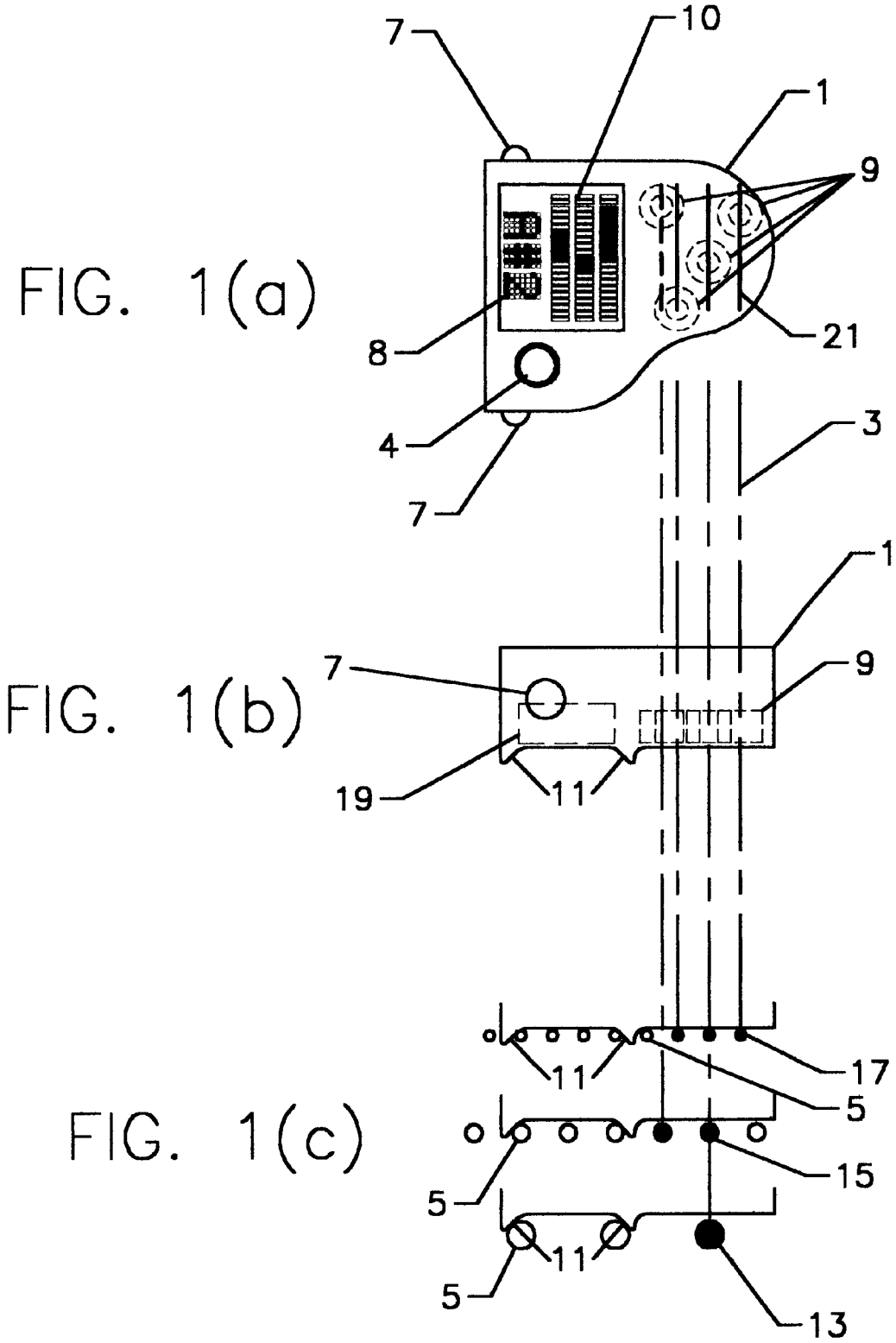
FIG. 1(*a*) is a schematic top view of the present invention showing a housing with extending lines to the piano strings.

FIG. 1(*a*) is a schematic top view of the present invention showing a housing 1 with extending lines 3 that indicate how the housing would normally be positioned on the lower piano strings 5 of the piano to be tuned. A push on and push off power button 4 is located on the top of the housing for power control of internal electronic circuits. The extension lines 3 to the piano strings are the same in all the FIG. 1 (*a*) to FIG. 1 (*c*) views. The housing 1 is made of a material like plastic, which is not affected by magnetic fields. The purpose of the internal electronics is to both make calculations based on the detected readings and provide for the transmission of data from the readings. The detected readings made by the magnetic attachments are made to piano strings, and the readings represent vibrations of each string. Based on the readings, the internal electronics determine what note is being tuned and the degree that the note is out-of-tune. This determined value is transmitted via infrared LEDs (light emitting diodes) 7 (see FIGS. 1(*a*) and 1(*b*)) similar to a television remote control, to a mechanical unit, not shown, where the transmitted signal is evaluated and appropriate mechanical action is automatically initiated to bring the note into perfect tune. Other transmission modes can be used, such as radio communications.

There are infrared transmitters 7 on both opposite sides of the housing 1 so that the housing may be placed either way on the strings. The information from the housing is transmitted in opposite order for each side to keep it compatible with the placement of wrench heads upon tuning pins of the piano. The pickup device in housing 1 may be used independent of the mechanical unit used for the automatic manual tuning and has an integral LCD readout 8 on its exposed upper face, see FIG. 1(*a*), which displays the note being tuned alphanumerically as well as the amount that each of the three strings is out-of-tune with individual bar graphs 10. The readout 8 can be considered a viewable digital display which indicates the note being detected and bar graphs 10 indicate how many cents sharp or flat, or error, for the same note under observation.

In FIG. 1(*a*), four spaced magnetic pickups 9, or detectors, are shown, in dotted line format, on the underside or bottom of the housing 1. Small protrusions, or ridges, 11 (see FIG. 1(*b*)) are molded into the plastic housing 1 and act as spacers between the piano strings. These protrusions or ridges 11 engage with strings adjacent to the ones being tuned and ensure that the pickup coils are properly aligned with their respective strings. The protrusions used are shown in their placement on the strings in FIG. 1(*c*) where they engage the underside of the housing with the strings 5 oriented as in FIG. 1(*c*). The lowermost strings 13 in FIG. 1(*c*) are single strings while the strings 15 are double strings and the strings 17 are triple strings.

Between the protrusions is a permanent magnet 19 (see dotted lines in FIG. 1(*b*)) used to hold the housing in place on the metallic strings whether on a grand or upright piano. Since the unit is used with its top side facing a user, as seen in FIG. 1(*a*), lines 21 may be marked or molded in the body of the housing 1 that can be visually aligned with the lower strings over which it is placed as an added verification that there is proper placement of the housing on the piano strings.

The housing 1 is a completely self-contained device that runs on a self contained power source consisting of a battery. There are no connecting wires from the housing to interfere with the vibrations of the strings. The housing is also small enough to fit into a user's pocket and accurate enough to be within one "cent" or $1/100^{th}$ of a musical half-step.

Figure 2:
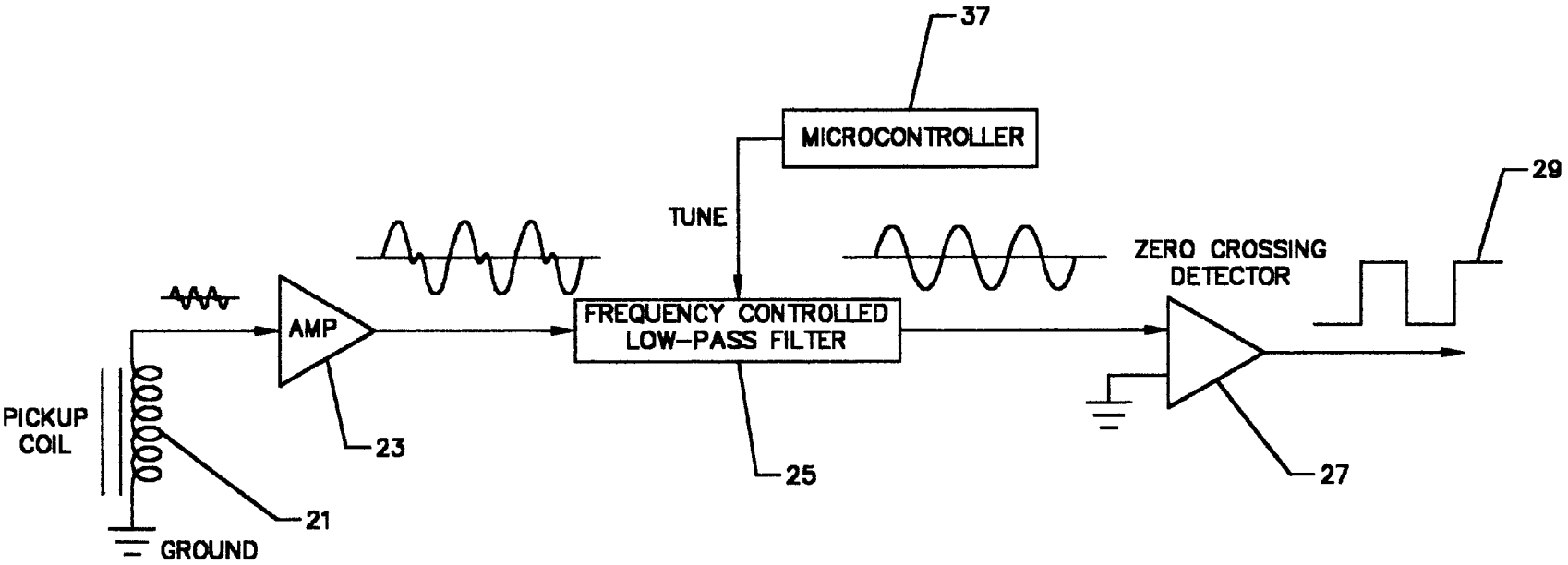
FIG. 2 is a diagram of the detected signals as observed on an oscilloscope.

FIG. 2 is a diagram of the detected signals as observed on an oscilloscope. A coil of wire 21 in the pickup units 9, shown in FIG. 1(*a*), is wrapped around a magnetic core and used to detect the vibration of ferrous objects, here strings, to produce a tuning signal. This type of pickup unit is commonly used in electric guitars as a "pickup." If this pickup is brought near a vibrating string, an electric current is induced in the coil that mimics the motion of the string. By using this type of pickup rather than a microphone, there can be no background noise, and each individual string may have its own dedicated pickup and be tuned independently even though all of the strings are vibrating together. Due to the standard spacing of piano strings, which may be in groups of one, two or three strings, an extra fourth pickup is necessary to detect some arrangements as shown in FIGS. 1(*a*)and 1(*c*).

The detected, or tuning, signal can be amplified by an amplifier 23 and viewed on a conventional oscilloscope, not shown. If the pickup is placed near the middle of a string, a sine wave is observed with a frequency equal to the fundamental frequency of the vibrating string. As the pickup is moved toward the end of the string, some harmonics are added which make the wave appear more complex. These overtones can be removed with a frequency controlled low-pass filter 25. If this signal is passed through a zero crossing detection circuit 27, it will become a square wave 29 with a period equal to the fundamental period of the string vibration.

Audio frequencies are relatively low and their waves are hard to count accurately without encountering the error of a fractional and incomplete wave. Frequency counting is therefore, not a viable solution for frequency measurement. A much more accurate method to be used is to measure the period of the wave or the time that lapses during one complete cycle. Ultra-high frequency oscillators are very common, small and quite inexpensive today. These oscillators work based on the oscillation of a tiny piezoelectric crystal and produce square waves with frequencies of many millions of cycles per second with extremely high accuracy. Clearly, if you can count the number of oscillator waves generated during a single audio wave, you can obtain a super precise value for the period and thus the pitch of the note. Thus, the tuning signal is processed to determine a first value for a tuning period of the tuning signal.

Figure 3:
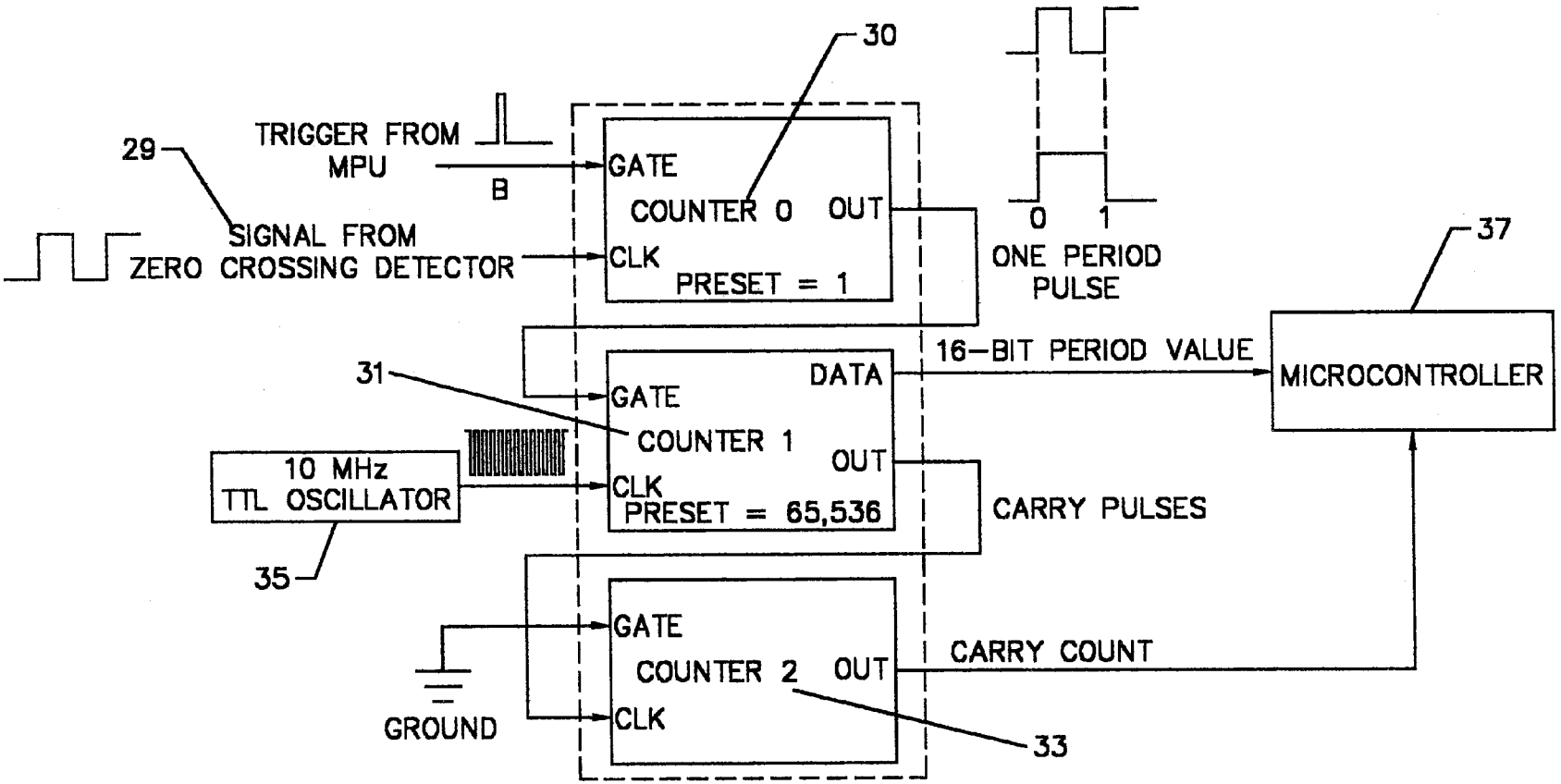
FIG. 3 is a block diagram of the programmable timer chip used.

To effect this desired result, a common Intel 82C54 programmable interval timer chip composed of three independent 16-bit counters that handle frequencies up to 10 MHz is used. Each of the chip counters has three connections: clock, gate and output as is illustrated in the block diagram of FIG. 3. The clock input is the signal 29 that is counted. The gate input signal B can have two different functions depending on the mode selected for the counter. Signal B is usually for gating the clock and allowing the counter to start counting the incoming pulses. Signal B can also be used as a trigger if the counter is programmed to operate in "one-shot" mode. The output is simply a signal to indicate that the counter has reached a preset value programmed into it. The first thing to do is fool the first counter 30 and use the audio square wave 29 from the zero crossing detector as the clock signal. This counter is set up as a one-shot. In one-shot mode the counter waits for a trigger pulse on its gate input and then counts clock inputs until the count reaches a preset value. The output is activated on the first rising edge of the clock input that occurs after a trigger pulse. The output is deactivated on the first rising edge of the clock input after the preset number of "ticks" is reached. If the preset value of the counter is set to "1" we obtain an output pulse with a duration equal to exactly one fundamental wave period.

The second chip counter 31 is programmed to operate in simple count-up mode. The output from the first counter 30 is sent to the gate of the second counter 31and a 10 MHz oscillator 35 to the clock input, counting the clock pulses during the one-period pulse. The second counter 31 counts the number of high-frequency pulses that occur during one period of vibration of the piano string. This value can be read by a microcontroller 37 and the exact period is now known. For example, for the musical note A440 (440 Hz) a correct equal temperament value for its period in terms of a 10 MHz clock would be 10,000,000 divided by 440 or 22,727 ticks. This value for a baseline period can be permanently stored in memory and used to compare and evaluate the measured signal. Thus, the first value for the tuning period of the tuning signal is compared to a second value for a baseline period of a musical note to evaluate the tuning signal.

Modem musical instruments are tuned to a standard known as equal temperament. The correct frequencies for all the notes of a piano can be determined by the equation:

$$f_N = 27.5 \times 2^{\frac{N}{12}} \tag{1}$$

where

N =number of a note on the piano with the lowest A being 0 and $f_N$ =correct frequency for note N.

The period of a wave is simply the reciprocal of its frequency, or $$T_N = \frac{1}{F_N} \tag{2}$$

$$T_N = \frac{f_c}{f_N} = \left|\frac{1 \times 10^7}{27.5 \times 2^{\frac{N}{12}}}\right| = \left|363{,}636 \times 2^{\frac{-N}{12}}\right| \tag{3}$$

where $f_c$ =clock frequency or 10 MHz.

Correct periods are thus calculated for all 88 notes on the piano and stored in EEPROM memory for comparison. Unfortunately for the lowest notes on a piano the periods become quite large (363,636 ticks for $A_o$) and exceed the 16 bit-capacity for the counter maximum ($12^{16}$ =65,536). To remedy this we set up the counter 31 to output a pulse whenever its 16 bit-accumulator is full, connect this output to counter 33 and count these overflows as a sort of "carry" bit to determine the total number. If period values are thought of in hexadecimal notation, the carry count is simply another digit. From the value, the microcontroller determines what note is being played by calculating which of the stored equal temperament periods the sampled note is closest to. Then it calculates how far the note is out-of-tune, or error.

The sound of a piano string is a composite of individual sine waves or partials and consists of a fundamental and many harmonics. The fundamental is what is perceived as the musical pitch. It is the fundamental that must be focused on when tuning a piano since when it is in tune all harmonics follow. Fortunately, for the piano, the fundamental is the lowest partial of all, which renders it easy to extract from the whole signal.

To isolate the fundamental of an audio signal a low-pass filter must be used which has a "cut-off" frequency above the fundamental frequency but below any higher harmonics or noise. For the device to be practical it must be able to automatically isolate the fundamental frequency for any piano strings that it is placed on. To do this, a frequency controlled low-pass filter, e.g, the National Semiconductor MF-4 filter, is used. The cut-off frequency for this type of filter is determined by the frequency of an input clock signal. For this example, the MF-4 filter, the cut-off frequency is 1/50th of the input clock frequency.

This frequency signal is provided by the microcontroller in the form of a square wave. The frequency of this signal is continuously increased to gradually raise the cutoff frequency of the filter. The output of the filter is monitored until it detects a signal. If no signal is detected by the time the filter is tuned to detect the highest piano fundamental frequency ($C_7$=4186Hz), the process is started over again and repeats continuously until one is detected. Once the filter is tuned into place the period measurement routine takes over as previously described.

Once the microcontroller has calculated values for the note value and error, it can transmit this data to an automatic piano tuner via the infrared LEDs 7. This piano tuner then automatically tunes the piano by turning pins with a wrench. As stated before, there are two infrared LEDs 7 that are aligned and located on opposite sides of the housing 1 (see FIG. 1(*a*)). This arrangement allows the housing to be placed upon the string either way depending on which is more convenient to the user. Data for each of the four pickups 9 is transmitted continuously, in regular order for one transmitter and in reverse order for the other transmitter.

The information is transmitted serially and asynchronously (similar to transmission to Recommended Standard no. 232 or RS-232 set up by the electronics industry for computer communications) to an infrared sensor in the automatic piano tuner, not shown. This standard designates a single-wire (or infra red) asynchronous serial connection where information is transmitted and received on a continuous, simple stream of 1's and 0's. There are certain voltages and communication conventions set forth in RS-232 so that computer can communicate.

Figure 4:
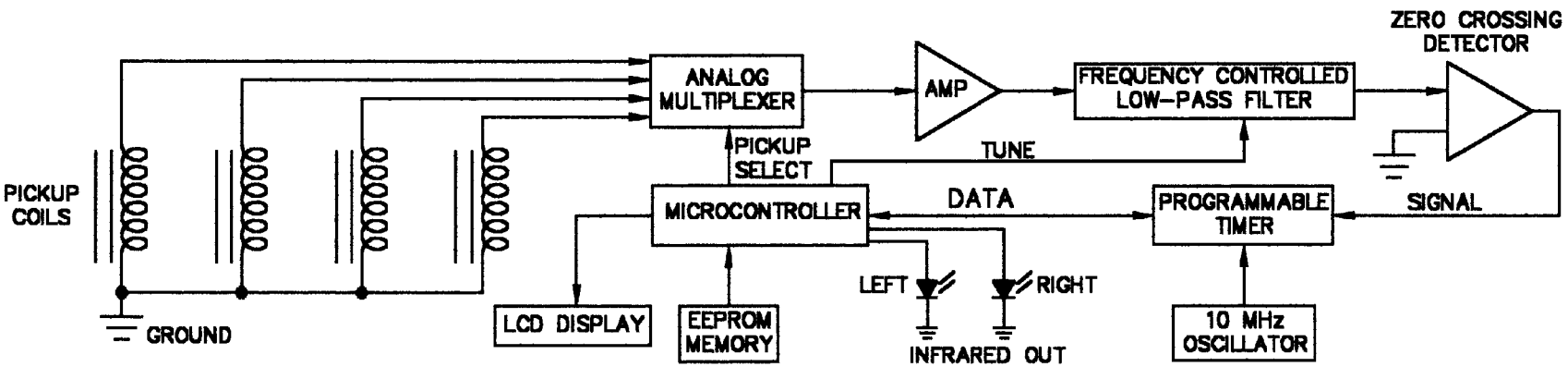
FIG. 4 is a block diagram of the circuit used in the present invention.

For each pickup a string of bytes is sent. First, a couple of identifying bytes are sent which indicate the beginning of the data so that if the infrared beam is blocked or interrupted, ambiguous data will not be received. These bytes are followed by bytes indicating which of the four pickups 9 is being read, and the value of the note from 1 to 88, the number of cents that the note is out-of-tune and whether it is sharp (i.e., above correct frequency) or flat (below correct frequency). A complete schematic diagram of the circuit is shown in the block diagram of FIG. 4.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A piano tuning device comprising:

a housing supporting a plurality of magnetic pickups and a plurality of piano strings, wherein each magnetic pickup of the plurality of the magnetic pickups being positionable over a separate piano string of the plurality of piano strings to create a signal that is representative of a note from each respective piano string of the plurality of piano strings;

a signal transmitter within the housing for transmitting the signal representative of the detected note; and a comparison device that compares the detected note signal against a stored note signal to determine a degree that the selected string is out of tune.

2. The piano tuning device as claimed in claim 1, wherein the signal representative of the detected note is being sent to a remote automatic piano tuner unit to evaluate and correct an out of tune string and bring the string into tune, wherein the remote automatic piano tuner houses the comparison device.

3. The piano tuning device as claimed in claim 1, wherein the housing comprises a material that is not subject to magnetic attraction.

4. The piano tuning device as claimed in claim 3, wherein the plurality of magnetic pickups within the housing include four magnetic pickups, the magnetic pickups are spaced from each other, and each of the pickups being positionable over a separate piano string of the plurality of piano strings.

5. The piano tuning device as claimed in claim 4, wherein the housing has a viewable digital display to indicate a note corresponding to the selected string, and bar graphs to indicate how many cents sharp or flat the note is.

6. The piano tuning device as claimed in claim 1, wherein the signal transmitter comprises an infrared signal transmitter.

7. The piano tuning device as claimed in claim 1, wherein the signal transmitter comprises two infrared signal transmitters, with one being located on each side of the housing.

8. The piano tuning device as claimed in claim 1, wherein the housing has an underside with spaced lower protrusions located on the underside of the housing, the protrusions being spaced apart a distance to engage piano strings adjacent to the strings being tuned, to ensure that the pickup coils are properly aligned with the strings.

9. The piano tuning device as claimed in claim 8, wherein the strings are magnetically attractable, and also including a permanent magnet mounted on the underside of the housing between the lower protrusions to hold the housing in place on the selected string whose note is detected to determine the degree the string is out of tune.

10. A piano tuning device comprising:

a housing supporting a plurality of magnetic pickups and a plurality of piano strings, wherein each magnetic pickup of the plurality of the magnetic pickups being positionable over a separate piano string of the plurality of piano strings to create a signal that is representative of a note from each respective piano string of the plurality of piano strings;

a signal transmitter within the housing for transmitting the signal representative of the detected note; and the signal being sent to a remote automatic piano tuner unit having a comparison device that compares the detected note signal against a stored note signal to evaluate and correct the selected piano string and bring the selected piano string into tune.

11. A method of tuning a musical instrument with strings comprising:

detecting vibration of a plurality of piano strings with a plurality of magnetic pickups, wherein each magnetic pickup of the plurality of the magnetic pickups being positionable over a separate piano string of the plurality of piano strings to create a signal that is representative of a note from each respective piano string of the plurality of piano strings;

processing the tuning signal to determine a first value for a tuning period of the tuning signal; and comparing the first value for the tuning period of the tuning signal to a second value for a baseline period of a musical note to evaluate the tuning signal.

12. The method as claimed in claim 11 wherein detecting vibration is performed without interfering with the strings.

13. The method as claimed in claim 11 wherein processing the tuning signal to determine the first value for the tuning period of the tuning signal includes isolating a fundamental of the tuning signal.

14. The method as claimed in claim 11 wherein the musical instrument comprises a piano.

15. The method as claimed in claim 11 wherein comparing the first value for the tuning period of the tuning signal to the second value for the baseline period of a musical note to evaluate the detected signal includes calculating values for note value and error.

16. The method as claimed in claim 15 including transmitting the note value and the error to an automatic piano tuner.

17. The method as claimed in claim 15 including indicating the musical note on a display.

18. The method as claimed in claim 15 including indicating the error on a display.

19. The method as claimed in claim 16 wherein transmitting the note value and the error to the automatic piano tuner comprises transmitting with infrared LEDs.

20. The method as claimed in claim 16 further comprising turning tuning pins thereby automatically tuning a piano.

21. An apparatus for tuning a piano comprising:

a detector operable to receive string vibrations from a plurality of piano strings with a plurality of magnetic pickups, wherein each magnetic pickup of the magnetic pickups being positionable over a separate piano string of the plurality of strings to produce a tuning signal for each piano string of the plurality of piano strings to is respresentative of note from each respective piano strings; and to produce a tuning signal; and a processor operable to receive the tuning signal, determine a first value for a tuning period of the tuning signal, and compare the first value for the tuning period of the tuning signal to a second value for a baseline period of a musical note to evaluate the tuning signal.

22. The apparatus as claimed in claim 21 wherein the processor is further operable to isolate a fundamental of the detected signal.

23. The apparatus as claimed in claim 21 wherein to compare the first value for the period of the tuning signal to the second value for the baseline period of the musical note to evaluate the tuning signal, the process is operable to calculate values for note value and error.

24. The apparatus as claimed in claim 23 further including a transmitter operable to send the note value and the error to an automatic piano tuner.

25. The apparatus as claimed in claim 24 wherein the transmitter is operable to send the note value and the error to an automatic piano tuner is performed via infrared LEDs.

26. The apparatus claimed in claim 24 further comprising the automatic piano tuner being operable to automatically tune the piano by turning pins with a wrench.

* * * * *

UNITED STATES PATENT AND TRADEMARK OFFICE

CERTIFICATE OF CORRECTION

PATENT NO. : 6,479,738 B1
DATED : November 12, 2002
INVENTOR(S) : Gilmore, Donald A.

It is certified that error appears in the above-identified patent and that said Letters Patent is hereby corrected as shown below:

Column 8,
Line 7, before the word “is” delete “to” and replace with -- create a signal that --;
Line 8, before the word “note” add -- a --;
Line 9, before the word “strings” add -- string of the plurality of piano --.

Signed and Sealed this

Eighth Day of April, 2003

JAMES E. ROGAN
*Director of the United States Patent and Trademark Office*